US005298095A

United States Patent [19]

Russo et al.

[11] Patent Number: 5,298,095

[45] Date of Patent: Mar. 29, 1994

[54] ENHANCEMENT OF HOT WORKABILITY OF TITANIUM BASE ALLOY BY USE OF THERMAL SPRAY COATINGS

[75] Inventors: Patrick A. Russo, Boardman; Stanley R. Seagle, Warren, both of Ohio

[73] Assignee: RMI Titanium Company, Niles, Ohio

[21] Appl. No.: 810,827

[22] Filed: Dec. 20, 1991

[51] Int. Cl.[5] ..... C22C 14/00

[52] U.S. Cl. ..... 148/670; 148/421; 148/669; 428/660; 428/661

[58] Field of Search ..... 148/421, 669, 670; 428/660, 661

[56] References Cited

U.S. PATENT DOCUMENTS

| | | | |
|---|---|---|---|
| 2,813,332 | 11/1957 | Keay, Jr. | 428/660 |
| 4,411,962 | 10/1983 | Johnson | 428/615 |
| 4,777,098 | 10/1988 | Takamura et al. | 428/660 |
| 4,830,683 | 5/1989 | Ferguson | 148/670 |
| 4,839,242 | 6/1989 | Murayama et al. | 428/660 |
| 4,839,242 | 6/1989 | Murayama et al. | 428/660 |
| 4,902,359 | 2/1990 | Takeuchi et al. | 148/133 |
| 4,915,746 | 4/1990 | Welsch | 428/661 |
| 4,966,816 | 10/1990 | Wardlan et al. | 428/660 |

FOREIGN PATENT DOCUMENTS

| | | |
|---|---|---|
| 771501 | 4/1957 | United Kingdom . |
| 1111938 | 5/1968 | United Kingdom . |
| 1517606 | 7/1978 | United Kingdom . |

OTHER PUBLICATIONS

Howard et al. Surface & Coating Technology, 45 May 1990, pp. 333–342.

Howard et al. Euromat 91, vol. 1, Adv. Processing, Cambridge, U.K. Jul. 1991, p. 338.

Koryagin et al. in Titanium & Titanium Alloys vol. I, ed. Williams et al., Plenum, N.Y., p. 253.

WPI Abstract Accession No.: 91-358522/49 and JP 030240973 A (Sailor Pen) Jan. 28, 1991.

WPI Abstract Accession No.: 92/205344/25 and JP 04136147 A (Nippon) May 11, 1992.

"Protective Coating for Titanium Alloy Parts in Hot Working", *Jinshu Rechuli*, vol. 8, 1991, pp. 48–49.

*Primary Examiner*—Upendra Roy

*Attorney, Agent, or Firm*—Scully, Scott, Murphy & Presser

[57] ABSTRACT

The present invention relates to a process in which a metal or metal alloy is thermal spray coated onto a base alloy material prior to hot working. More specifically, the invention relates to the use of plasma coating of titanium over a titanium alloy plate for improved hot workability. This combination allows the crack-sensitive base alloy to be rolled with a minimum of surface and edge cracks. In addition, by using a plasma sprayed titanium coating there is a reduction in the roll force required to reduce the material during the hot working process.

9 Claims, 8 Drawing Sheets

ENHANCEMENT OF HOT WORKABILITY OF TITANIUM BASE ALLOY BY USE OF THERMAL SPRAY COATINGS

FIELD OF THE INVENTION

The invention concerns a process for improving the hot workability of a base alloy material by applying a thermal coating of a metal or metal alloy over the base alloy. A preferred aspect of the invention relates to the use of plasma spray coating of titanium powder over a crack sensitive titanium alloy base material which is to be hot worked.

DISCUSSION OF ART

Titanium alloys are generally difficult to hot work because of surface and edge cracks which do form during the working process. These cracks can ultimately lead to loss of material or difficult workability of the metal plate. One method available to alleviate this cracking problem is to enclose the material to be rolled in a welded pack. This method requires that the welded pack material be easier to hot work than the inside material. The major drawback of this method is that the condition of the inside material is unknown during the rolling process. Therefore, it may be found only after removing the packing that the reductions were too large resulting in a significant amount of material cracking. If the cracking of the metal is severe, the enclosed material will require substantial conditioning and resultant material loss. In extreme cases, the enclosed material may be unsalvageable which makes this particular method both undesirable and costly to the producer.

In addition to the pack method for rolling, glass-ceramic coating has been used. This type of coating is known to reduce the pickup of hydrogen and oxygen, but it has not been reported whether this method leads to improved hot workability. A major disadvantage of using this coating is their low coefficient of friction, which results in difficulty in gripping the coated material by the work rolls during the rolling process. This factor alone causes many plate mill operators to avoid rolling any material which is known to be coated with glass ceramics.

The use of thermal spraying techniques to coat materials is well known. This technique is generally used to coat structures or parts whose shape and size may be susceptible to damage by the heating requirements of other coating techniques. Thermal spray coating can be achieved by using one of the following methods: oxy-acetylene flame, detonation gun, arc, plasma, laser, electrostatic powder or slurry coating.

Slurry and electrostatic powder coatings usually require heating to the fusion temperature either by massive heating of the part or by localized heating. Flame and arc spraying techniques are the most commonly used methods in industrial coating application because equipment is relatively easy to move to the work site.

The plasma spraying process mentioned above utilizes energy in a controller electric arc to heat gases to temperatures exceeding 8000° C. Argon, nitrogen, or hydrogen are usually the gases of choice. These gases are heated in annules and are expelled at high velocity and temperature in a characteristic flame. Metallic or non-metallic powder particles are melted and accelerated to the material to be coated. Coatings applied by this method are generally known to be extremely fine, dense, wear-resistant, and have characteristic porosities of 5–15%. For best coating results, a narrow distribution should be applied since large particles may pass unmelted through the flame using the plasma process.

SUMMARY OF INVENTION

The invention involves the use of thermal spraying of titanium or a titanium alloy to form a coating over a base titanium alloy material to enhance hot workability of the material. This procedure allows the base material to be rolled with a minimum of cracking with no significant loss of product. In accordance with the present invention, a process is provided wherein titanium metal is intimately coated on a base material prior to hot working and rolling. Because the coating is relatively thin, this method allows the monitoring of the base material during the hot working process. Thus if any cracks form, the process can be terminated and the metal can be reconditioned and recoated for further working without loss of material.

DETAILED DESCRIPTION OF INVENTION

The present invention is essentially applicable to titanium alloys which are difficult to hot work because of surface and edge cracks that form during the hot working process. Some titanium alloys which are crack sensitive and exhibit this difficulty in hot working include: Alloy C (a Pratt and Whitney titanium base alloy), Super Alpha 2 titanium aluminide, Ti-5Al-2.5Sn, and Ti-8Al-1Mo-1V. Even Ti-6Al-4V may also exhibit substantial cracking tendencies under certain conditions.

A preferred aspect of the invention is that the metal coating is applied to the base material by using a plasma spraying technique. The coating metal is comprised of titanium or a titanium alloy while the base material is comprised of a titanium alloy. The titanium alloy which is applied as a coating on the base material has better hot workability than the base material. A preferred alloy coating for this process having the above mentioned characteristics is a Ti6A14V alloy. In its most preferred form, the invention contemplates the use of substantially pure titanium for coating the base material.

One of the functions of thermally applying a metallic coating, either metal or metal alloy, to the base metal prior to hot working is that a reduction of heat transfer from the coated material to the working die or roll is observed therefor resulting in a easier rolling process. More importantly, a metallic coating is chosen so that it forms an alloy with the base material such that the alloy formed is easier to hot work than the original starting alloy. The metallic coating may also function as a getter of surface oxygen thereby minimizing the amount of $O_2$ available to cause contamination and embrittle the surface of the base material.

The metallic coating applied by plasma spraying is substantially evenly applied over the surfaces of the base material to form a layer with a thickness of at least 0.01 inch. It is preferred that the coating have a thickness from about 0.03 to 0.04 inch but the coating may range up to a thickness of about 0.1 inch. The inventive process can be applied to any shape or size alloy since size or shape is not critical to the process.

Once coated, the alloy is then ready for hot-working. This process is achieved at temperatures normally employed for hot rolling the metal piece, i.e. from about 1500° F. to about 2500° F. The material is reduced to the final gauge by means of rolls or dies.

A further important aspect of this invention is that coating on the base material results in a reduction in the roll force required during hot rolling. Therefore, greater reduction per pass and wider width material can be rolled using this invention. In some cases, a reduction of about 50% in roll force is observed when the base material is plasma coated prior to hot working.

After hot-working, the metallic coating can be removed from the base material by grit blasting. It should be noted that the resultant hot-worked material which was previously coated has significant improvements in the surface and edge quality than the uncoated material. The final product has substantially less cracking with the metallic coating than without such coating.

DESCRIPTION OF FIGURES

FIGS. 4A and 4B show the top and bottom sides respectively whereas

The benefits of using thermal (plasma) sprayed coating for improving hot workability of difficult to work alloys is apparent in the following examples. These examples illustrate both surface edge quality improvements and reduction in roll forces required to deform the base material.

The following examples are given to illustrate the invention

EXAMPLE I

Figure 1A:
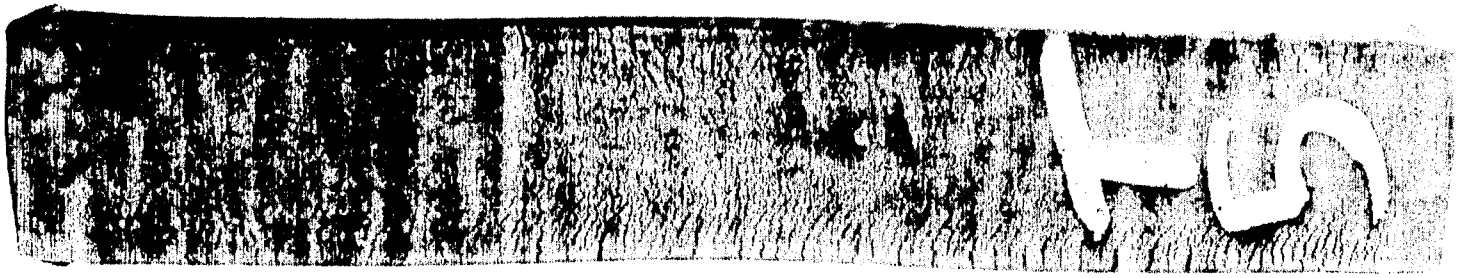
FIGS. 1A and 1B show both sides, top and bottom, of an uncoated 1.5 inch thick Alloy C which was rolled from a starting thickness of 3.5 inch from a 2100° F. furnace. A 10% reduction per pass was performed to achieve the final gauge.
Figure 1B:
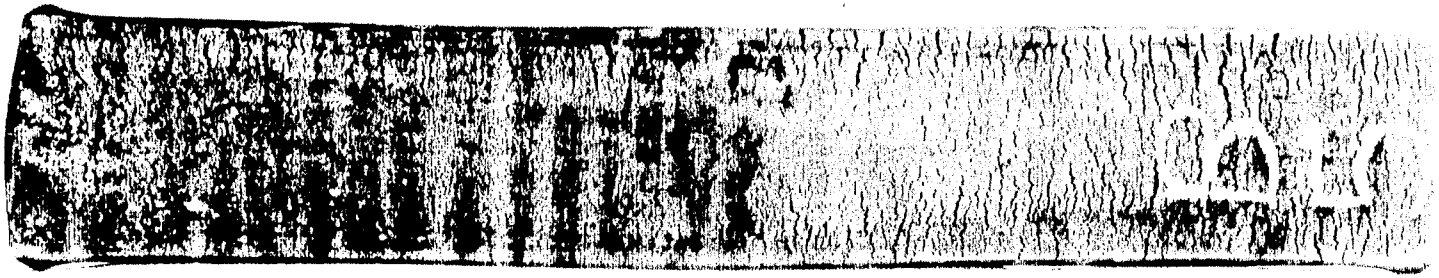
Figure 2A:
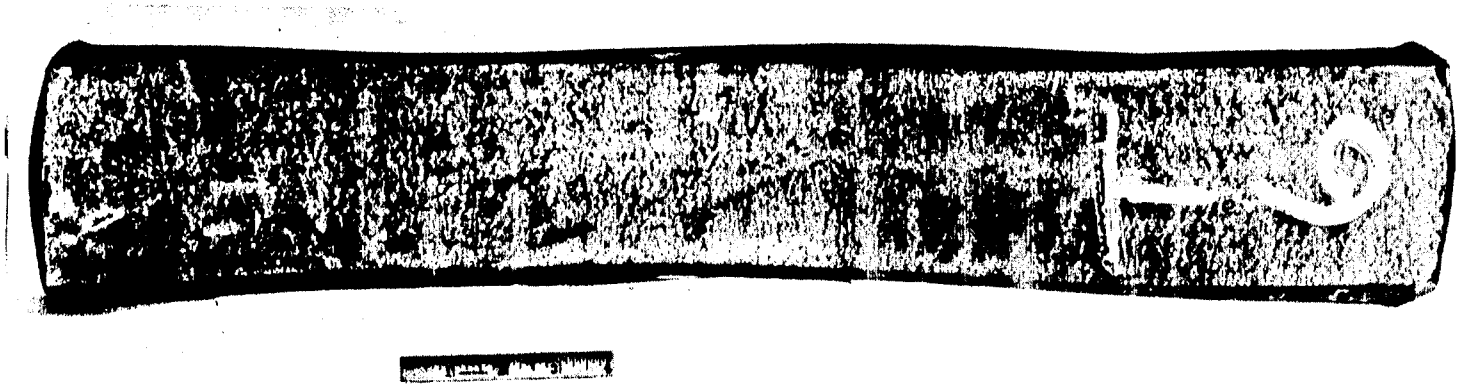
FIGS. 2A and 2B represent the top and bottom sides of a 1.5 inch thick Alloy C which was plasma sprayed in air with titanium powder to a coating thickness of 0.030–0.040 inch. This alloy had a starting thickness of 3.5 inch and was hot worked from a 2100° F. furnace. A 10% reduction per pass was performed until the final gauge was obtained.
Figure 2B:
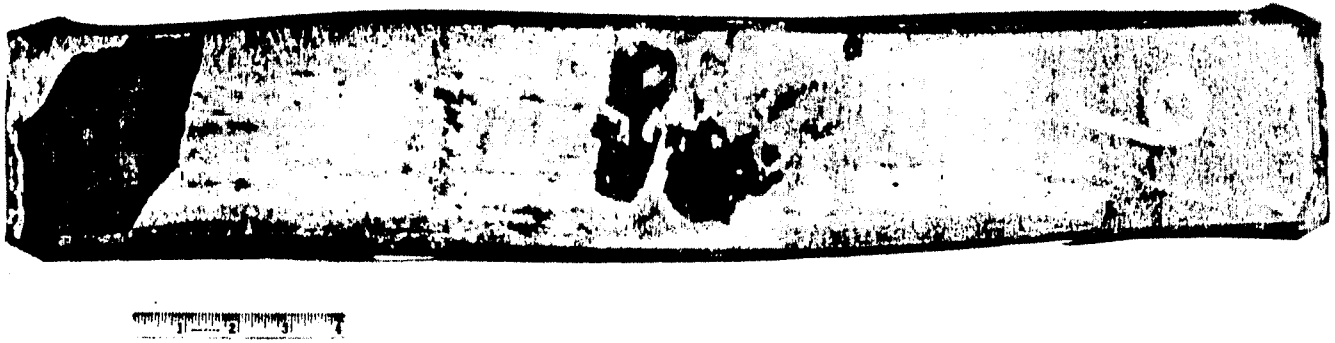

FIGS. 1A, 1B and 2A, 2B show both sides (top and bottom) of a 1.5 inch thick Alloy C, a Pratt and Whitney titanium base alloy, after rolling from a 2100° F. furnace. FIGS. 1A and 1B represent the control experiment wherein no coating was applied prior to hot working the material whereas FIGS. 2A and 2B represent a plate which is coated with 0.030–0.040 inch thick titanium applied by plasma-spraying of a titanium powder. The starting plate thickness in each case was 3.5 inch. The two plates were worked so that reduction of 10% per pass were taken until the final gauge (1.5 inch) was obtained. No reheating was performed in each case after the hot working process was terminated. It is clearly seen by comparing the two figures that the coated material had significantly less surface and edges cracks than the uncoated plate.

Figure 3A:
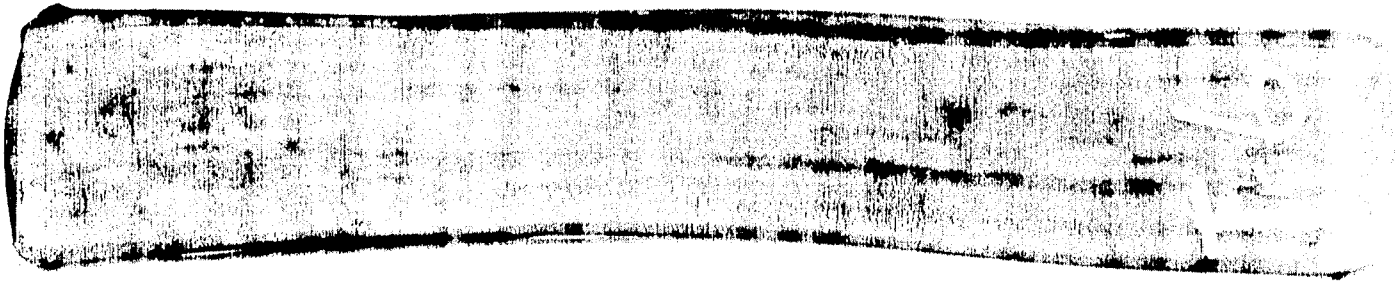
FIGS. 3A and 3B represent the top and bottom sides of the 1.5 inch thick Alloy C which was described in FIGS. 2A and 2B after removal of the titanium coating by grit blasting.
Figure 3B:
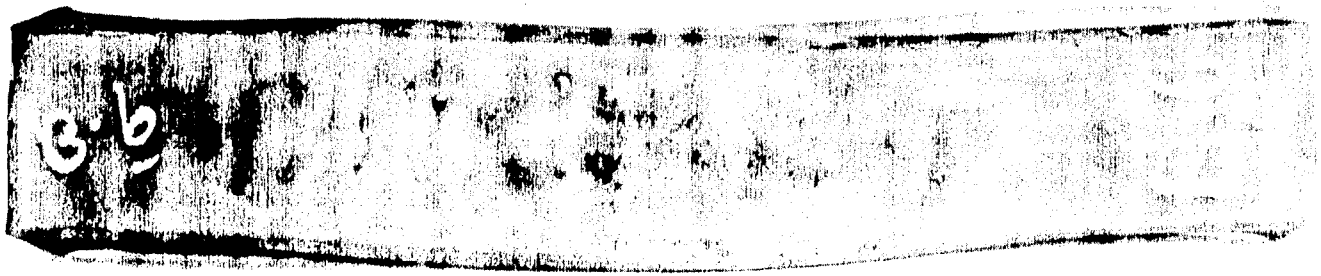

Grit blasting to remove the titanium coating from the plate was then performed. FIGS. 3A and 3B show both sides of the 1.5 inch thick Alloy C material after this process. It is apparent that the coating protected the base material from surface and edge cracks.

EXAMPLE II

Figure 4A:
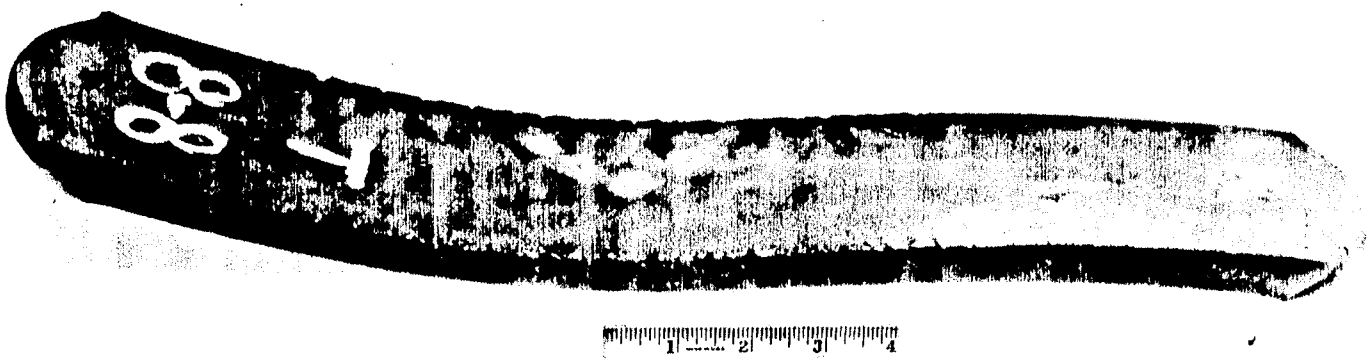
Figure 4B:
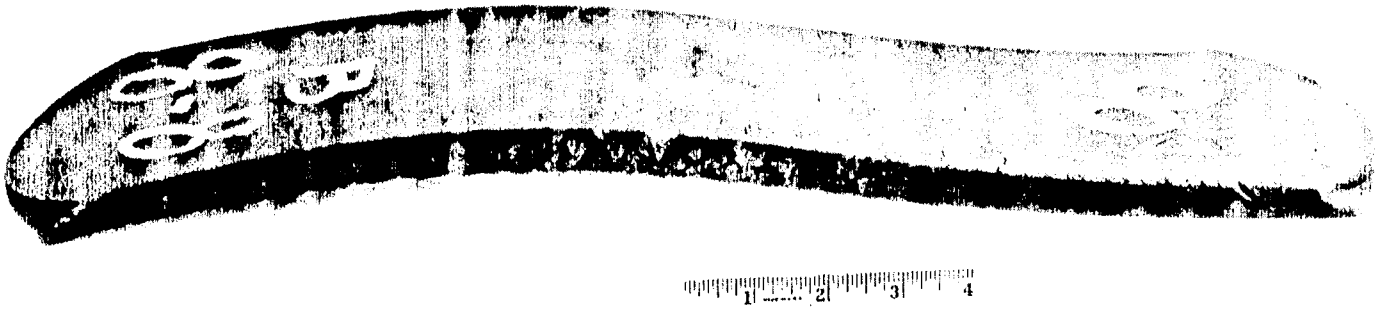
Figure 5A:
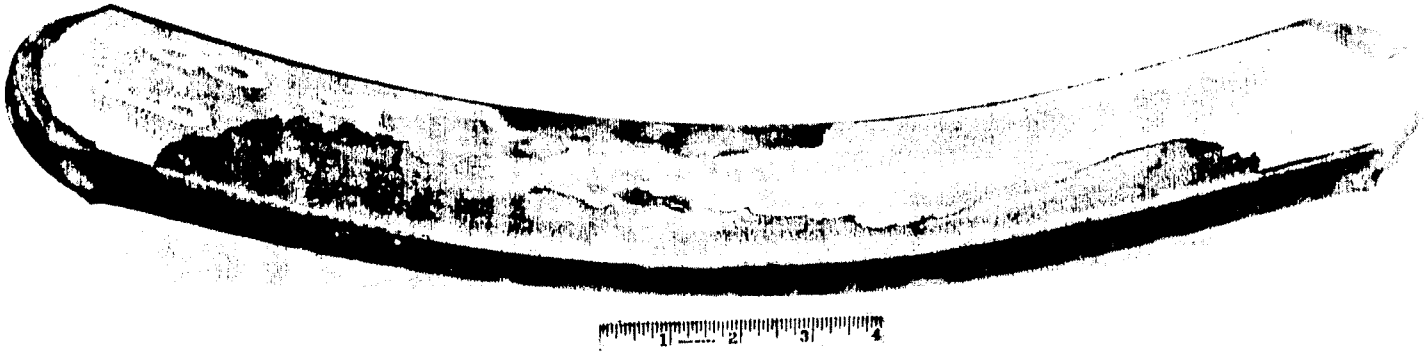
FIG. 5A and 5B represent the top and bottom sides of an uncoated and coated 0.5 inch Alloy C rolled from a 1950° F. furnace. Each material had a starting thickness of 2.25 inch and 12% reduction per pass were performed on them to obtain the final gauge. The coated Alloy C (FIGS. 5A and 5B) was plasma sprayed in air with titanium powder to a coating thickness of 0.030–0.040 inch.
Figure 5B:
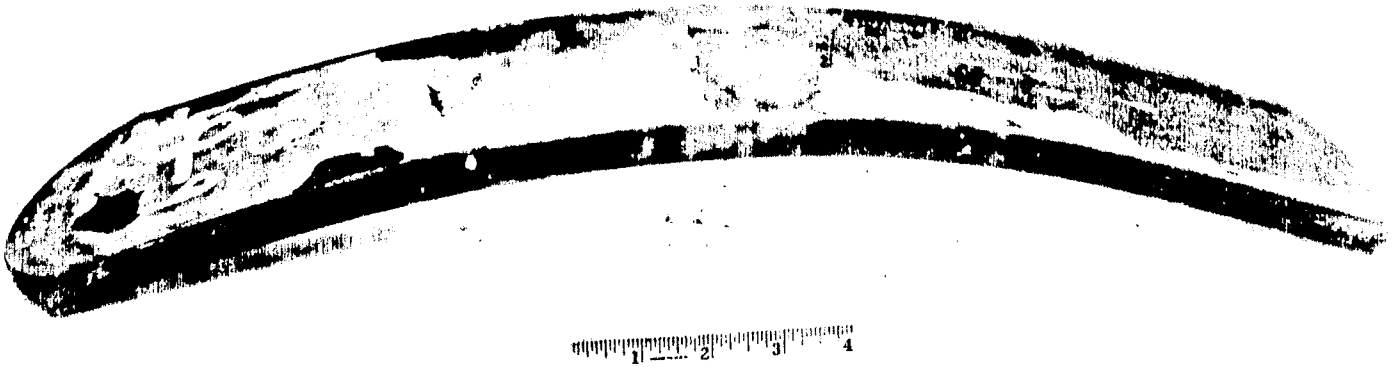
Figure 6A:
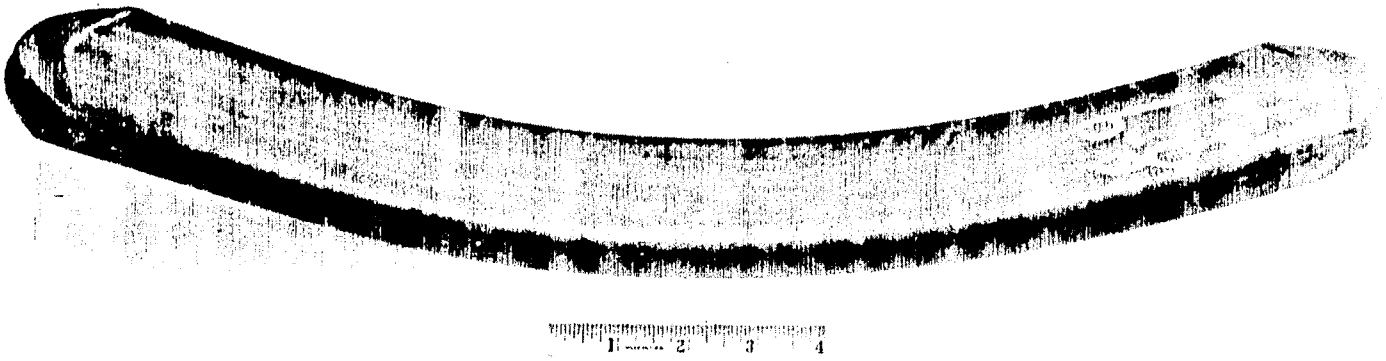
FIGS. 6A and 6B show the top and bottom sides of an 0.5 inch thick Alloy C after grit blasting was performed on the material to remove the titanium coating.
Figure 6B:
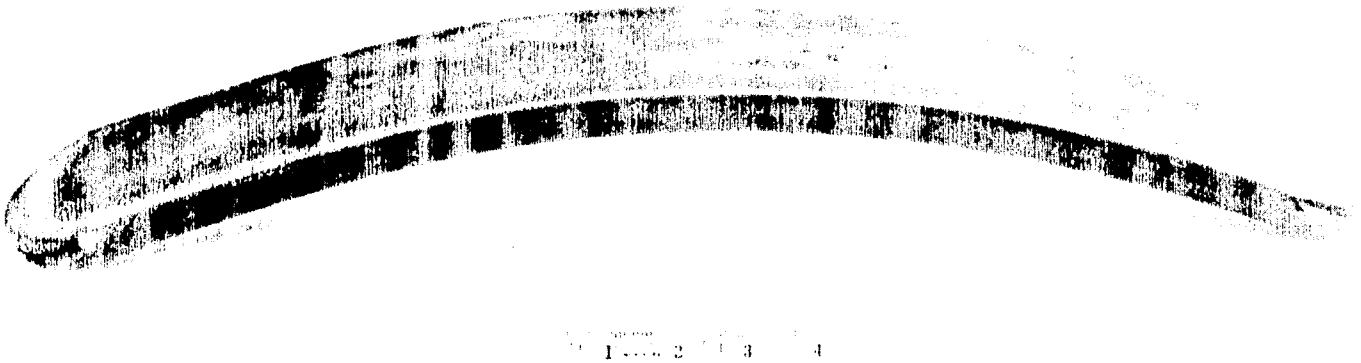

FIGS. 4A and 4B (uncoated) and 5A and 5B (coated) show both sides of 0.5 inch Alloy C plate rolled from a 1950° F. furnace. In each case, the starting gauge was 2.25 inch. FIGS. 5A and 5B were plasma sprayed in air with titanium powder to a coating thickness of 0.030–0.040 inch prior to the working process. Both materials were rolled with reductions of 12% per pass. No reheating was performed after this process. At this thinner gauge, the improvement in edge and surface quality in the plasma coated material is apparent. FIGS. 6A and 6B show the results after the coating was removed by grit blasting. It is also apparent from this figure that coating greatly improved the overall surface and edge quality of the material.

EXAMPLE III

The last example shows the reduction in roll force required to reduce the material during hot working achieved by applying a plasma titanium coating to the base material.

Figure 7:
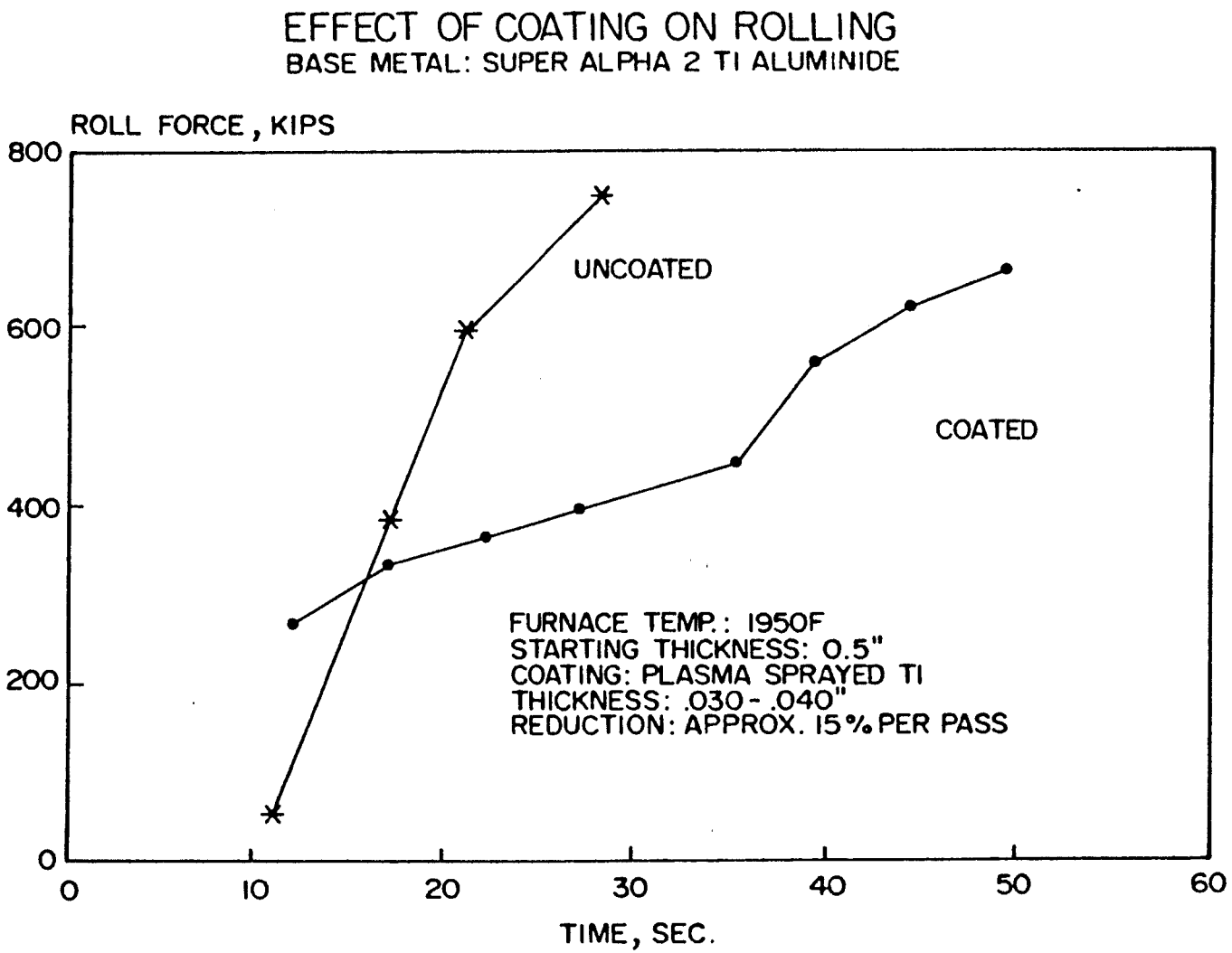
FIG. 7 and FIG. 8 show the mills forces for each pass of the rolling of an alloy which has been worked. Each graph contains a coated and uncoated alloy therefor the effects of coating on hot working can be studied.

FIG. 7 shows mill forces for each pass of the rolling of a 0.5 inch thick Super Alpha 2 titanium aluminide from a 1950° F. furnace. Reductions of about 15% per pass were performed on the control and coated material. On the fourth pass, the uncoated material required 749 Klb to perform the reduction, and the process had to be terminated because of the 1 Mlb capacity of the mill. However, the material which was plasma sprayed with 0.030–0.040 inch thick titanium had a mill force of only 396 Klb after the fourth pass. A reduction of 47.1% compared to the uncoated material was observed. The plasma coated material was then rolled the desired 8 passes to a final gauge of 0.234 inch requiring a maximum roll force of only 664 Klb.

Figure 8:
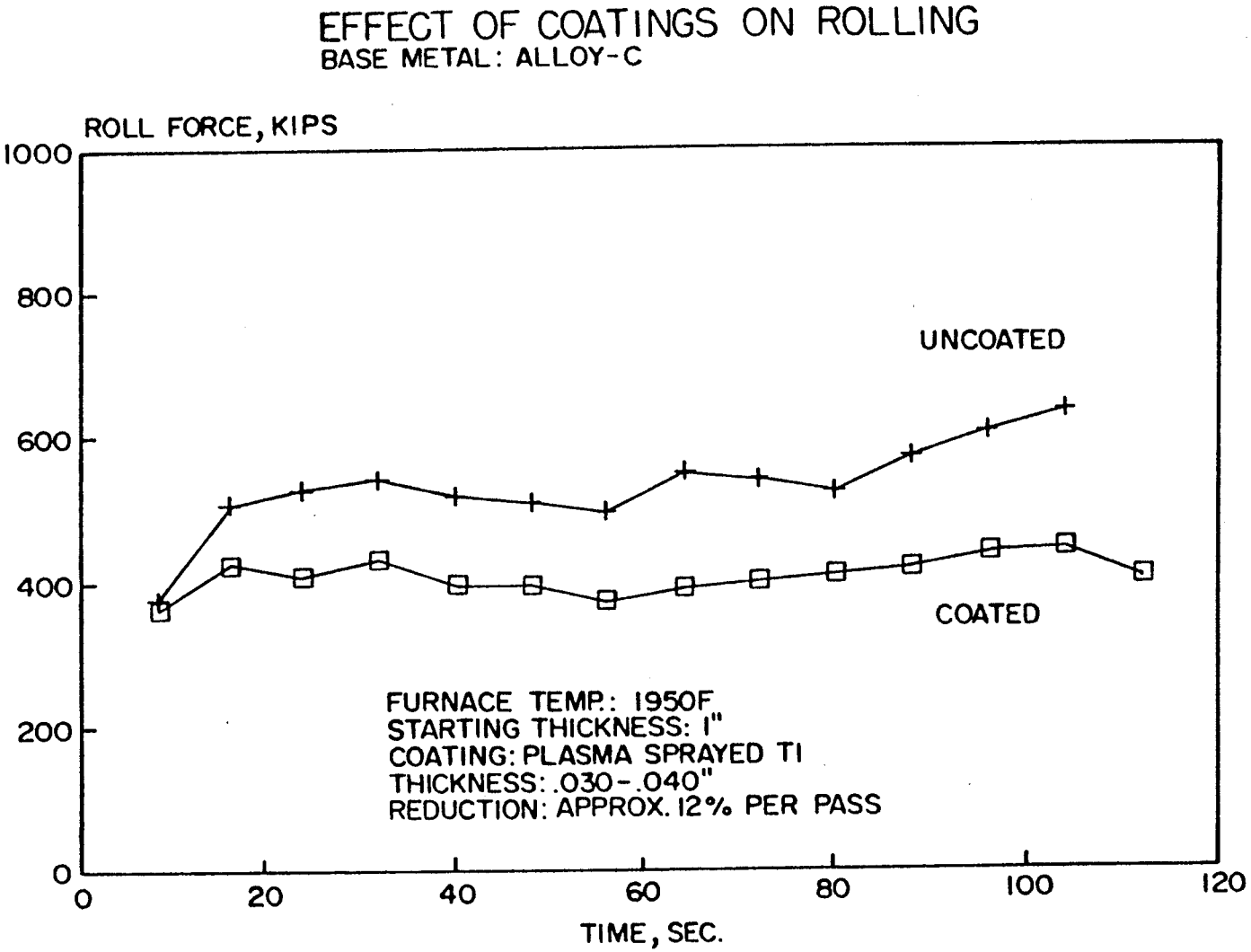

Another example of the reduction in roll force is shown in FIG. 8. This figure shows the mill roll forces for each pass for the rolling of 1 inch Alloy C plate from a 1950° F. furnace. A 12% reduction per pass was used to achieve the final gauge. It is apparent that the 0.030–0.040 inch titanium coated material required less rolling force than the uncoated alloy. On the final pass, the uncoated material required a peak force of 538 Klb compared to 404 Klb peak force for the coated material. This represents a reduction of about 24.9% in roll force which is directly attributable to the coating process.

What is claimed is:

1. A process for hot working a crack-sensitive titanium base alloy comprising (i) prior to hot-working the base alloy, applying a metal or metal alloy coating to the base alloy by thermally coating the base alloy with a layer of titanium or a titanium alloy which is more easily hot workable than the base alloy, and then (ii) hot working the thermally coated base alloy.

2. A process according to claim 1 wherein said, coating is applied by plasma coating.

3. A process according to claim 1 wherein said coating has a thickness of at least 0.01 inch.

4. A process according to claim 1 wherein said metal or metal alloy coating thickness is from about 0.030 to about 0.040 inch.

5. A process according to claim 1 wherein said hot working is effected with dies or rolls.

6. A process according to claim 1 wherein said metal or metal alloy coating forms an alloy at the interface of said coating and the surface of the base material.

7. A process according to claim 1 wherein said metal or metal alloy coating is removed from the base alloy.

8. A process according to claim 1 wherein said coated base alloy is hot worked at a temperature from about 1500° F. to about 2500° F.

9. A process according to claim 7 wherein said coating is removed by grit blasting.

* * * * *

UNITED STATES PATENT AND TRADEMARK OFFICE

CERTIFICATE OF CORRECTION

PATENT NO. : 5,298,095

DATED : March 29, 1994

INVENTOR(S) : Patrick A. Russo, et al.

It is certified that error appears in the above-indentified patent and that said Letters Patent is hereby corrected as shown below:

On the Title Page, Section [56]: delete second occurrence of "4,839,242 6/1989 Murayama et al..... ....428/660--

On the Title Page, Section [56]: "Wardlan" should read --Wardlaw--

Column 3, line 56: after "invention" insert --.--

Column 4, line 67, Claim 2: after "said" insert --metal or metal alloy--

Column 5, line 1, Claim 3: after "said" insert --metal or metal alloy--

Column 6, line 3, Claim 3: "material" should read --alloy--

Signed and Sealed this

Eleventh Day of October, 1994

*Attest:*

*Attesting Officer*

BRUCE LEHMAN

*Commissioner of Patents and Trademarks*